US012276109B2

(12) United States Patent
Chan

(10) Patent No.: US 12,276,109 B2
(45) Date of Patent: Apr. 15, 2025

(54) VENTILATION ASSEMBLY

(71) Applicants: Chih-Hsueh Lin, Miami, FL (US); Ya-Ching Chan, Taichung (TW)

(72) Inventor: Ya-Ching Chan, Taichung (TW)

(73) Assignees: Ya-Ching Chan, Taichung (TW); Chih-Hsueh Lin, Miami, FL (US)

( * ) Notice: Subject to any disclaimer, the term of this patent is extended or adjusted under 35 U.S.C. 154(b) by 476 days.

(21) Appl. No.: 17/760,996

(22) PCT Filed: Sep. 15, 2020

(86) PCT No.: PCT/IB2020/058546
§ 371 (c)(1),
(2) Date: Mar. 16, 2022

(87) PCT Pub. No.: WO2021/053499
PCT Pub. Date: Mar. 25, 2021

(65) Prior Publication Data

US 2022/0307266 A1 Sep. 29, 2022

(30) Foreign Application Priority Data

Sep. 20, 2019 (TW) ..... 108134057

(51) Int. Cl.
*E04D 13/17* (2006.01)
*F24F 7/02* (2006.01)
(Continued)

(52) U.S. Cl.
CPC ..... *E04D 13/17* (2013.01); *F24F 7/02* (2013.01); *F24F 13/20* (2013.01); *F24F 13/222* (2013.01)

(58) Field of Classification Search
CPC ... E04D 13/17; F24F 7/02; F24F 13/20; F24F 13/222; F24F 8/10; F24F 2221/16
USPC ..... 454/367
See application file for complete search history.

(56) References Cited

U.S. PATENT DOCUMENTS 3,251,158 A * 5/1966 Shapiro ..... E04D 13/0352 52/72
3,788,013 A * 1/1974 Veen, Jr. ..... F24F 7/02 49/7
(Continued)

FOREIGN PATENT DOCUMENTS

CN 101986049 A 3/2011
CN 108265892 A 7/2018
(Continued)

OTHER PUBLICATIONS

Search Report and English Translation of TW Patent Application No. 108134057, dated Jul. 9, 2020.
(Continued)

*Primary Examiner* — Avinash A Savani
*Assistant Examiner* — Ryan L Faulkner
(74) *Attorney, Agent, or Firm* — RAPHAEL BELLUM PLLC

(57) ABSTRACT

A ventilation assembly (200) includes a frame unit (100) and a cover body (60). The frame unit (100) includes two frame assemblies (10) and two closing plates (30) connected between the frame assemblies (10). Each frame assembly (10) includes two frame seats (11) and outer and inner side plates (12, 13) cooperatively defining a tortuous passage (14). Each frame assembly (10) further includes first and second air vents (15, 16). The cover body (60) is connected to and cooperates with the frame assemblies (10) and the closing plates (30) to define an air chamber (70) configured to communicate with an opening (102) in an upper portion (1) of a building. The first air vent (15) is provided to communicate the air chamber (70) with the tortuous passage (14), and the second air vent (16) is provided to communicate the tortuous passage (14) with the atmosphere.

8 Claims, 7 Drawing Sheets

(51) Int. Cl.
*F24F 13/20* (2006.01)
*F24F 13/22* (2006.01)

(56) References Cited

U.S. PATENT DOCUMENTS

| | | | | |
|---|---|---|---|---|
| 2018/0224132 | A1* | 8/2018 | Gonzalez | F24S 10/753 |
| 2019/0017275 | A1 | 1/2019 | Chan | |
| 2019/0017276 | A1* | 1/2019 | Chan | E04D 13/17 |
| 2019/0210317 | A1* | 7/2019 | Walker | E04F 17/04 |
| 2019/0249889 | A1 | 8/2019 | Chan | |

FOREIGN PATENT DOCUMENTS

| | | | | | |
|---|---|---|---|---|---|
| DE | 102012002109 | A1 | | 8/2013 | |
| JP | 2001-90288 | A | | 4/2001 | |
| JP | 2007-92416 | A | | 4/2007 | |
| TW | M470862 | U | | 1/2014 | |
| TW | M526600 | U | | 8/2016 | |
| TW | M529723 | U | | 10/2016 | |
| TW | 107105564 | | * | 2/2018 | E04D 13/0357 |
| TW | I638933 | B | | 10/2018 | |
| TW | 201908664 | A | | 3/2019 | |

OTHER PUBLICATIONS

International Search Report of PCT International Application No. PCT/IB2020/058546 dated Dec. 31, 2020.
Written Opinion of PCT International Application No. PCT/IB2020/058546 dated Dec. 26, 2020.

* cited by examiner

VENTILATION ASSEMBLY

FIELD

The disclosure relates to a ventilation assembly, more particularly to a ventilation assembly installed in a building.

BACKGROUND

An existing structure of a roof having a heat dissipation effect, as disclosed in Taiwanese Patent No. M526600, includes two spaced-apart frames disposed on two sides of an opening of a roof of a building, a cover plate corresponding to the opening and fixedly connected to top ends of the frames, and two decorative plates each of which is connected between the roof and a bottom end of a corresponding one of the frames.

Each frame includes a first frame and a second frame connected to each other. The first frame includes a pair of side plates, a top plate connected between the side plates, and a bottom plate connected between the side plates and opposite to the top plate. After the first frame is made of aluminum extrusion, it is necessary to form holes in one of the side plates and the bottom plate, and a hole mold must be prepared for the hole-forming operation. However, in respond to different sizes of the frame, a hole mold must be prepared, and the production cost of the hole mold is high, so that the overall manufacturing cost is increased.

SUMMARY

Therefore, an object of the present disclosure is to provide a ventilation assembly that can alleviate at least one of the drawbacks of the prior art.

According to this disclosure, a ventilation assembly includes a frame unit and a cover body. The frame unit includes two frame assemblies, and two closing plates connected between the frame assemblies. Each frame assembly includes at least two frame seats spaced apart from each other in a first direction, an outer side plate connected between the frame seats, and an inner side plate connected between the frame seats and spaced apart from and opposite to the outer side plate. The frame seats, the outer side plate and the inner side plate of each frame assembly cooperatively define a tortuous passage. Each frame assembly further includes a first air vent cooperatively defined by at least the inner side plate and the frame seats, and a second air vent cooperatively defined by at least the outer side plate and the frame seats. The cover body is connected to and cooperates with the frame assemblies and the closing plates to define an air chamber. The air chamber is configured to communicate with an opening in an upper portion of a building. The first air vent is provided to communicate the air chamber with the tortuous passage, and the second air vent is provided to communicate the tortuous passage with the atmosphere.

BRIEF DESCRIPTION OF THE DRAWINGS

Other features and advantages of the disclosure will become apparent in the following detailed description of the embodiments with reference to the accompanying drawings, in which.

DETAILED DESCRIPTION

Figure 1:
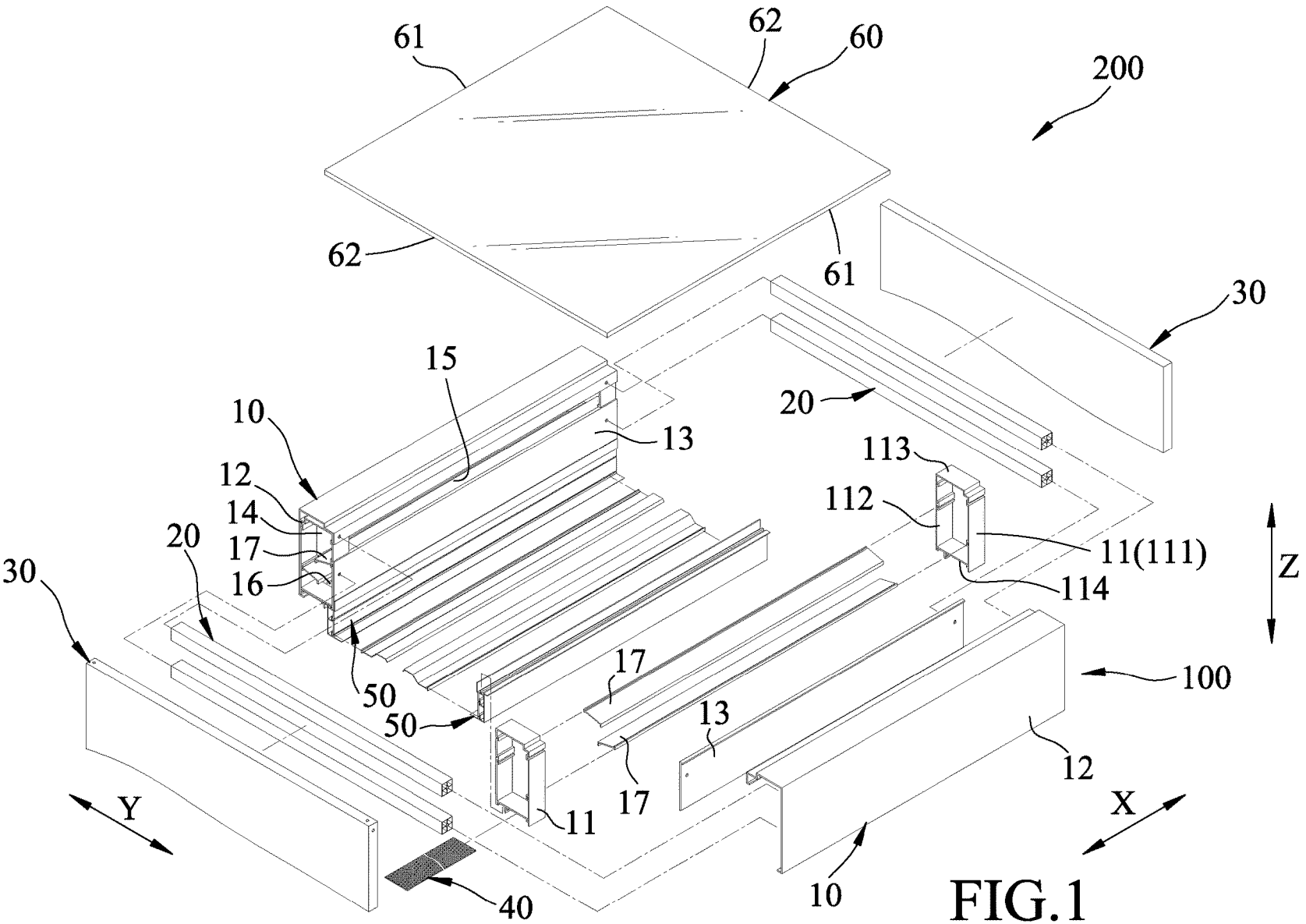
FIG. 1 is an exploded perspective view of a ventilation assembly according to the first embodiment of the present disclosure.

Before the present disclosure is described in greater detail with reference to the accompanying embodiments, it should be noted herein that like elements are denoted by the same reference numerals throughout the disclosure.

Figure 2:
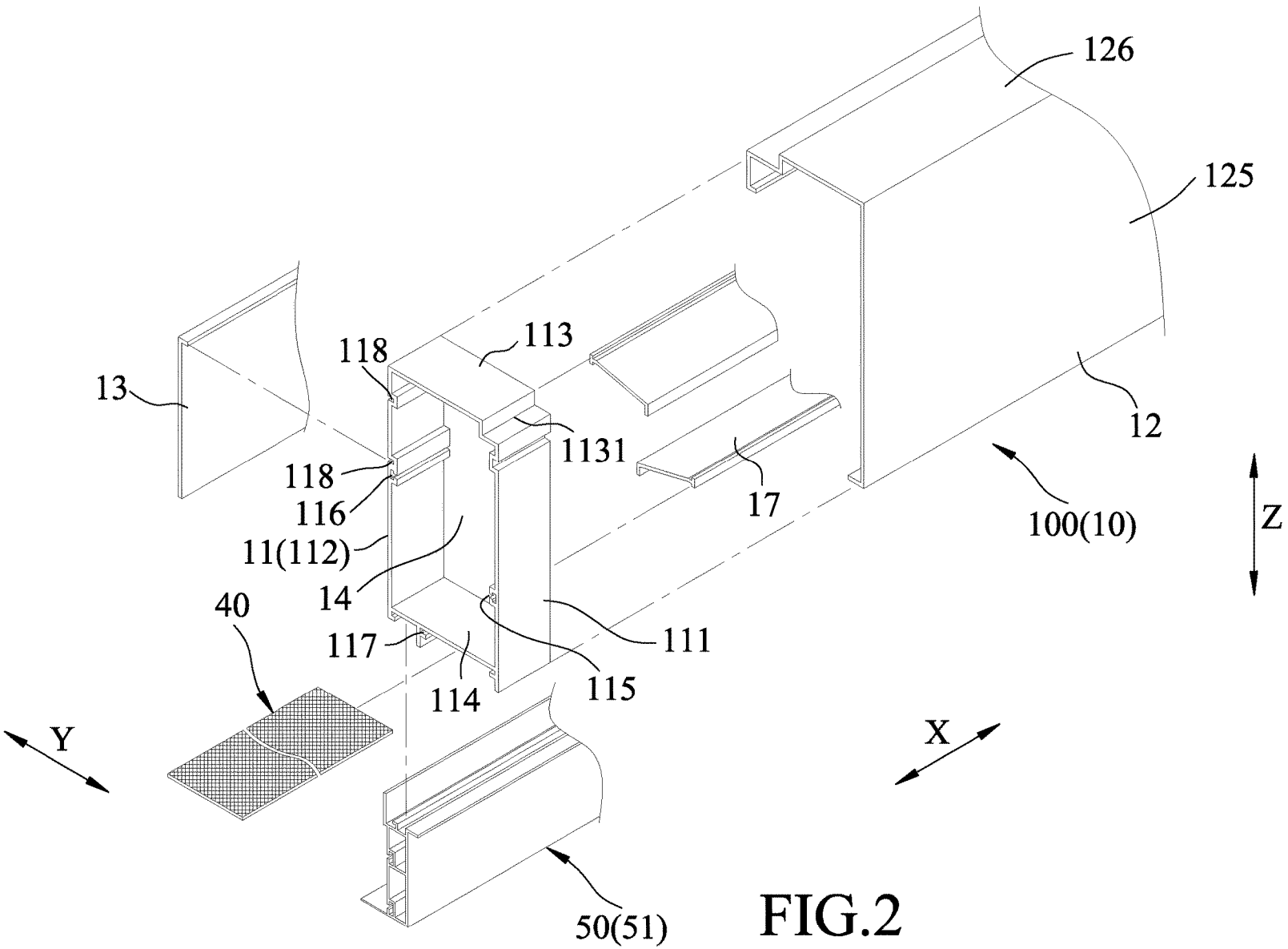
FIG. 2 is an enlarged fragmentary perspective view of FIG. 1.
Figure 3:
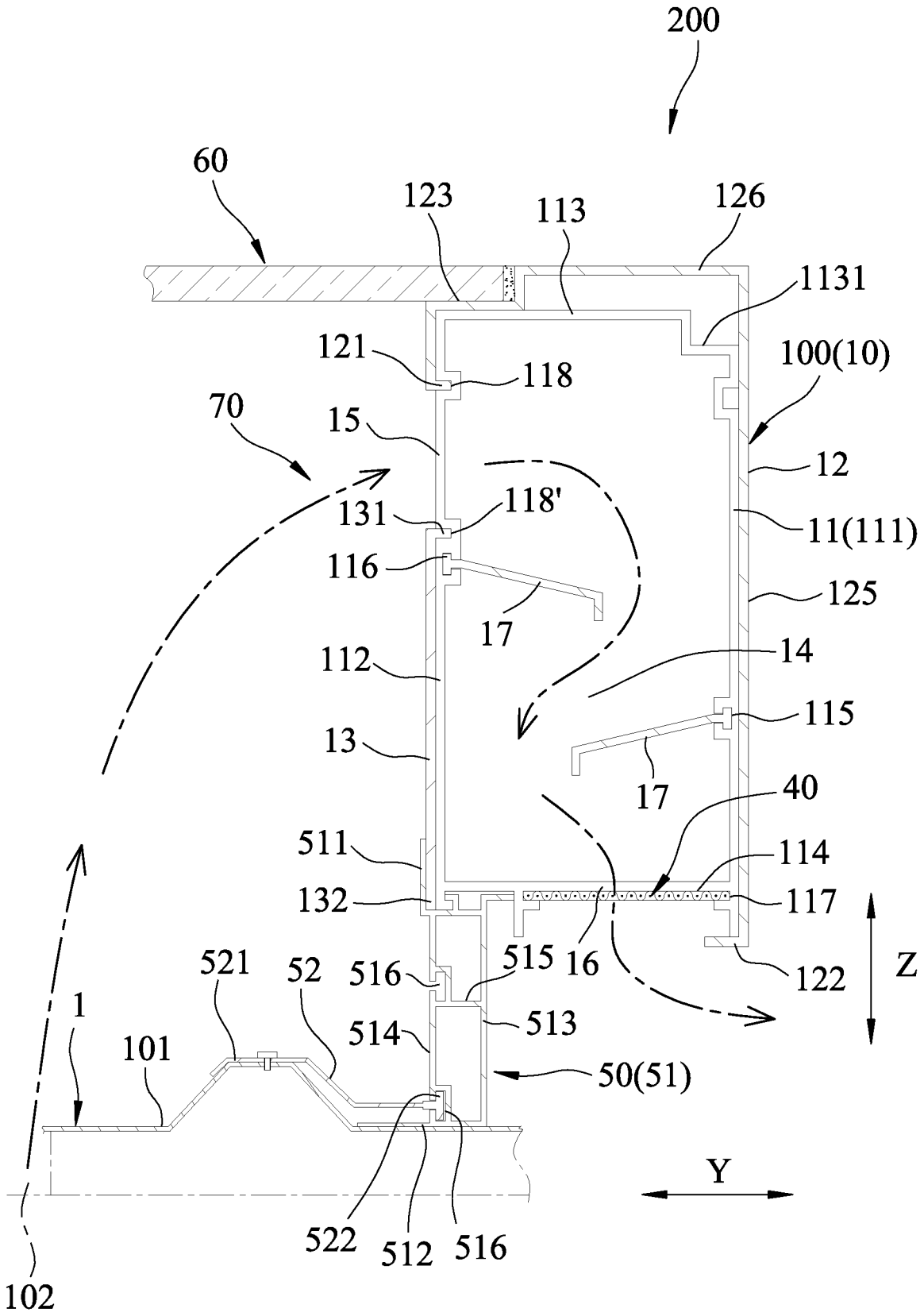
FIG. 3 is a fragmentary assembled sectional view of the first embodiment.

Referring to FIGS. 1 to 3, a ventilation assembly 200 according to the first embodiment of the present disclosure is configured for mounting on an upper portion 1 of a building. In this embodiment, the upper portion 1 of the building is a roof. The upper portion or roof 1 has an outer surface 101, and an opening 102 extending through the outer surface 101. The ventilation assembly 200 includes a frame unit 100, two mounting units 50, and a cover body 60.

The frame unit 100 includes two frame assemblies 10, a plurality of connecting rods 20, two closing plates 30, and two filter screens 40 (only one is visible in FIG. 1).

Each frame assembly 10 includes two frame seats 11 spaced apart from each other in a first direction (X), an outer side plate 12 connected between the frame seats 11, and an inner side plate 13 connected between the frame seats 11 and spaced apart from and opposite to the outer side plate 12. The frame seats 11, the outer side plate 12 and the inner side plate 13 cooperatively define a tortuous passage 14. Each frame assembly 10 further includes a first air vent 15 cooperatively defined by at least the inner sideplate 13 and the frame seats 11, and a second air vent 16 cooperatively defined by at least the outer side plate 12 and the frame seats 11.

Each frame seat 11 has an outer wall 111 fixed to the outer side plate 12 adjacent to one end thereof, an inner wall 112 fixed to the inner side plate 13 adjacent to one end thereof, a top wall 113 connected between top ends of the outer and inner walls 111, 112, and a bottom wall 114 connected between bottom ends of the outer and inner walls 111, 112. The outer wall 111 has a first engaging groove 115 with a T-shaped cross section perpendicular to the first direction (X) and adjacent to the tortuous passage 14. The inner wall 112 has a second engaging groove 116 with a T-shaped cross section perpendicular to the first direction (X) and adjacent to the tortuous passage 14, and two positioning grooves 118, 118' spaced apart from each other in a second direction transverse to the first direction (X) and opening in a direction opposite to that of the second engaging groove 116. The first and second engaging grooves 115, 116 are staggered with respect to each other. The top wall 113 has an outer depression 1131 adjacent to the outer wall 111. The bottom wall 114 has a track 117 provided on a bottom portion thereof.

Each frame assembly 10 further includes two guide plates 17 respectively engaged to the first and second engaging grooves 115, 116 and located within the tortuous passage 14.

The outer side plate 12 has an L-shaped cross section perpendicular to the first direction (X), and has a first end 121 engaged to the positioning grooves 118 of the inner walls 112 of the frame seats 11, a second end 122 that is opposite to the first end 121, that is engaged to bottom portions of the outer walls 111 of the frame seats 11 and that is proximate to the bottom walls 114 of the frame seats 11, and an inner depression 123 proximate to the first end 121 and located on an outer side of the top wall 113. The inner side plate 13 has a first end 131 engaged to the positioning grooves 118' of the inner walls 112 of the frame seats 11 and spaced apart from the first end 121 of the outer sideplate 12, and a second end 132 that is opposite to the first end 131, that is proximate to a junction of the inner wall 112 and the bottom wall 114 of each frame seat 11 and that is positioned thereat by the mounting unit 50.

In this embodiment, the first air vent 15 of each frame assembly 10 is proximate to the top walls 113 of the frame seats 11, and is cooperatively defined by the frame seats 11, the first end 131 of the inner side plate 13, and the first end 121 of the outer side plate 12. The second air vent 16 of each frame assembly 10 is located between the bottom walls 114 of the frame seats 11, and is cooperatively defined by the frame seats 11, the second end 132 of the inner side plate 13, the second end 122 of the outer side plate 12, and the mounting unit 50. The frame assemblies 10 are spaced apart from each other in a third direction (Y) transverse to the first and second directions (X, Z).

In this embodiment, the outer side plate 12 of each frame assembly 10 includes a main plate portion 125 positioned on outer sides of the outer walls 111 of the frame seats 11, and a cover plate portion 126 that is connected to a top end of the main plate portion 125, that is disposed on outer sides of the top walls 113 of the frame seats 11 and that covers a top side of the tortuous passage 14. The cover plate portion 126 has the first end 121 and the inner depression 123, while the main plate portion 125 has the second end 122. The main plate portion 125 and the cover plate portion 126 are integrally connected as one body.

The connecting rods 20 extend along the third direction (Y). In this embodiment, four connecting rods 20 are exemplified. Two of the connecting rods 20 are connected between the cover plate portions 126 of the outer side plates 12 of the frame assemblies 10 in proximity to the first ends 121 thereof, while the other two connecting rods 20 are connected between the inner side plates 13 of the frame assemblies 10.

The closing plates 30 extend along the third direction (Y), are connected between the frame seats 11 of the frame assemblies 10, and are located on outer sides of the connecting rods 20.

Each filter screen 40 extends along the first direction (X), is removably disposed between the tracks 117 of the frame seats 11 of a respective one of the frame assemblies 10, and corresponds to the second air vent 16 of the respective one of the frame assemblies 10.

The mounting units 50 are connected to the frame unit 100 for mounting the ventilation assembly 200 on the roof 1. Each mounting unit 50 is fixed between the frame seats 11 of the respective one of the frame assemblies 10, and includes a mounting seat 51 fixed to the bottom portions of the bottom walls 114 of the frame seats 11, and a connecting member 52 connected to the mounting seat 51. The mounting seat 51 has an upper clamping portion 511 clamping the second end 132 of the inner side plate 13 against the inner walls 112 of the frame seats 11, a lower mounting portion 512 having a flat plate shape and configured for abutting against the outer surface 101 of the roof 1, an outer wall portion 513 connected between the upper clamping portion 511 and the lower mounting portion 512, an inner wall portion 514 connected between the upper clamping portion 511 and the lower mounting portion 512 and spaced apart from the outer wall portion 513, and a partition plate 515 connected between the inner and outer wall portions 514, 513. The inner wall portion 514 has two engaging grooves 516 spaced apart from each other in the second direction (Z). The connecting member 52 has a fitting portion 521, and an engaging portion 522 opposite to the fitting portion 521 and engaged to a selected one of the engaging grooves 516. The fitting portion 521 has a shape conforming with the outer surface 101 of the roof 1. Each of the engaging groove 516 and the engaging portion 522 has a T-shaped cross section.

The cover body 60 is connected to and cooperates with the frame assemblies 10 and the closing plates 30 to define an air chamber 70. The air chamber 70 is configured to communicate with the opening 102 in the roof 1. The cover body 60 may be made of a plastic plate or tempered glass, and has two opposite sides 61 respectively fixed to the inner depressions 123 of the outer side plates 12 of the frame assemblies 10 through an adhesive (silicone), and another two opposite sides 62 respectively fixed to top ends of the closing plates 30 through an adhesive (silicone).

The first air vent 15 is provided to communicate the air chamber 70 with the tortuous passage 14, and the second air vent 16 is provided to communicate the tortuous passage 14 with the atmosphere.

With reference to FIG. 3, after the ventilation assembly 200 is assembled, and is mounted and positioned on the outer surface 101 of the roof 1, heat inside the building can be discharged outwardly (see the imaginary arrows) through the opening 102 in the roof 1, the air chamber 70, and the first air vents 15, the tortuous passages 14 and the second air vents 16 of the frame assemblies 10, thereby achieving the purpose of ventilation and heat dissipation.

In this embodiment, through the assembly of the two frame seats 11 and the outer and inner side plates 12, 13 of each frame assembly 10, the first air vent 15 and the second air vent 16 can be formed, so that this disclosure can solve the problem of the existing frame which needs to perform hole processing operation after it is made of aluminum extrusion. Since the preparation cost of making mold can be omitted in this disclosure, the manufacturing cost thereof can thus be reduced.

Further, by using the outer and inner side plates 12, 13 made of different lengths to cooperate with two or more of the frame seats 11, a frame unit 100 of different length specifications may be assembled. The manufacturing and material management of the outer and inner side plates 12, 13 are convenient, and the outer and inner side plates 12, 13 do not occupy much space so that the transportation cost is low. As such, the cost of this disclosure can also be reduced. Besides, the assembly of the frame unit 100 is quite easy.

Moreover, the mounting seat 51 of each mounting unit 50 is provided with the two engaging grooves 516 spaced apart from each other in the second direction (Z), and the engaging portion 522 of the connecting member 52 can selectively engage with one of the engaging grooves 516 to match the shape of the outer surface 101 of the roof 1, so that the applicability of the mounting unit 50 is relatively wide. Additionally, the upper clamping portion 511 of the mounting seat 51 can clamp the second end 132 of the inner sideplate 13 against the inner walls 112 of the frame seats 11, apart from positioning the inner side plate 13 relative to the frame seats 11, the upper clamping portion 511 also has the function of preventing moisture from penetrating into the air chamber 70 or an interior of the building through the mounting seat 51, the frame seats 11 and the inner side plate 13.

With the cover body 60 being made of a plastic plate or tempered glass with good light transmission, apart from closing the top side of the air chamber 70, the cover body 60 can also allow sunlight to illuminate the interior of the building, so that the interior has good lighting, and the consumption of indoor lighting fixtures can be reduced, thereby saving energy.

Figure 4:
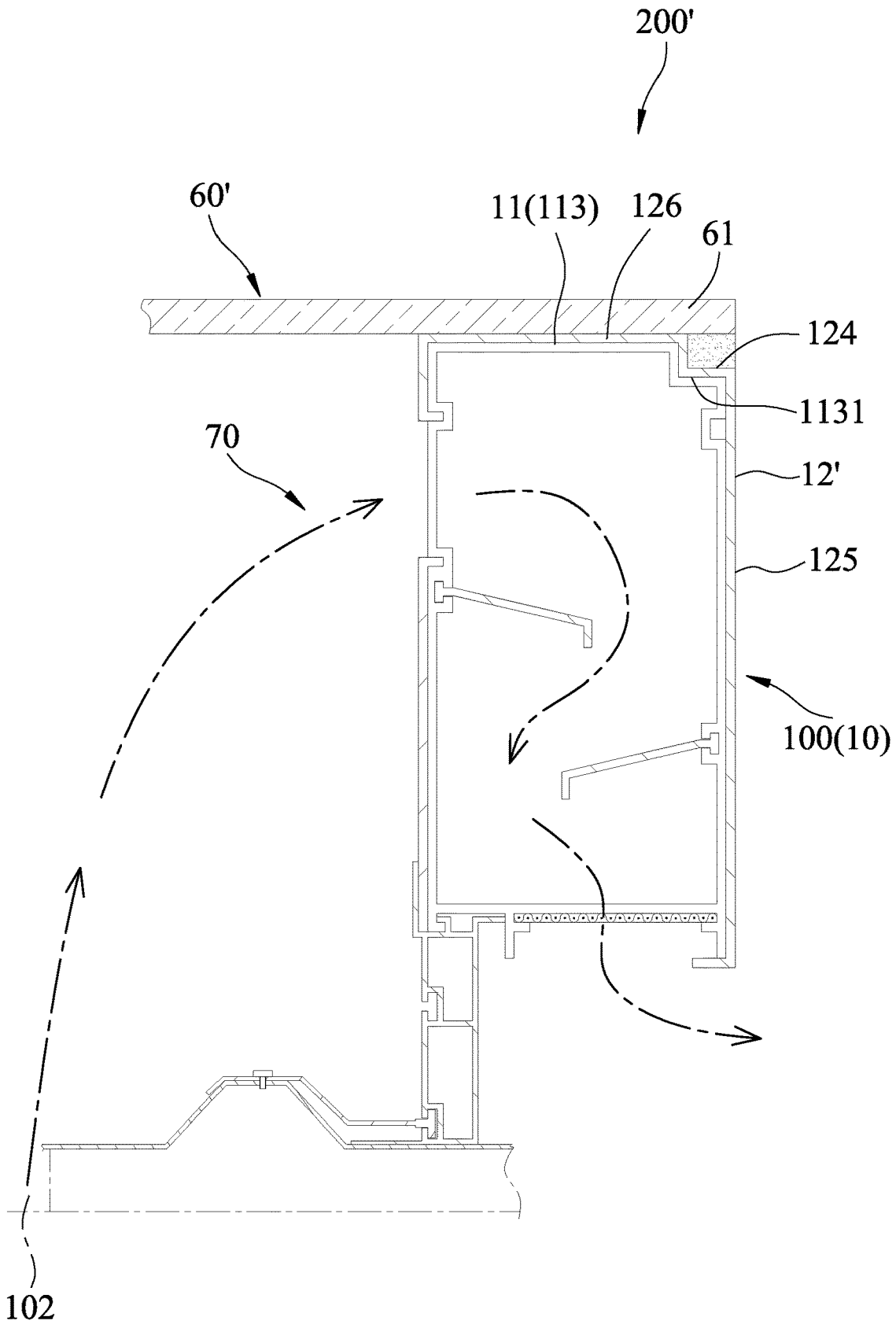
FIG. 4 is a fragmentary assembled sectional view of a ventilation assembly according to the second embodiment of the present disclosure.

FIG. 4 is a fragmentary assembled sectional view of a ventilation assembly 200' according to the second embodiment of the present disclosure. The second embodiment is substantially identical to the first embodiment. However, in the second embodiment, the outer side plate 12' of each frame assembly 10 of the frame unit 100 has a top depression 124 formed in a junction of the main plate portion 125 and the cover plate portion 126 and matching the shape of the outer depression 1131 in the top wall 113 of the frame seat 11. In this case, the cover body 60' has a larger area than that in the first embodiment. Adhesive (silicone) is filled in the top depression 124 to fix the side 61 of the cover body 60' on the cover plate portion 126 of the outer sideplate 12'. The cover body 60' can similarly cover the top side of the air chamber 70.

Figure 5:
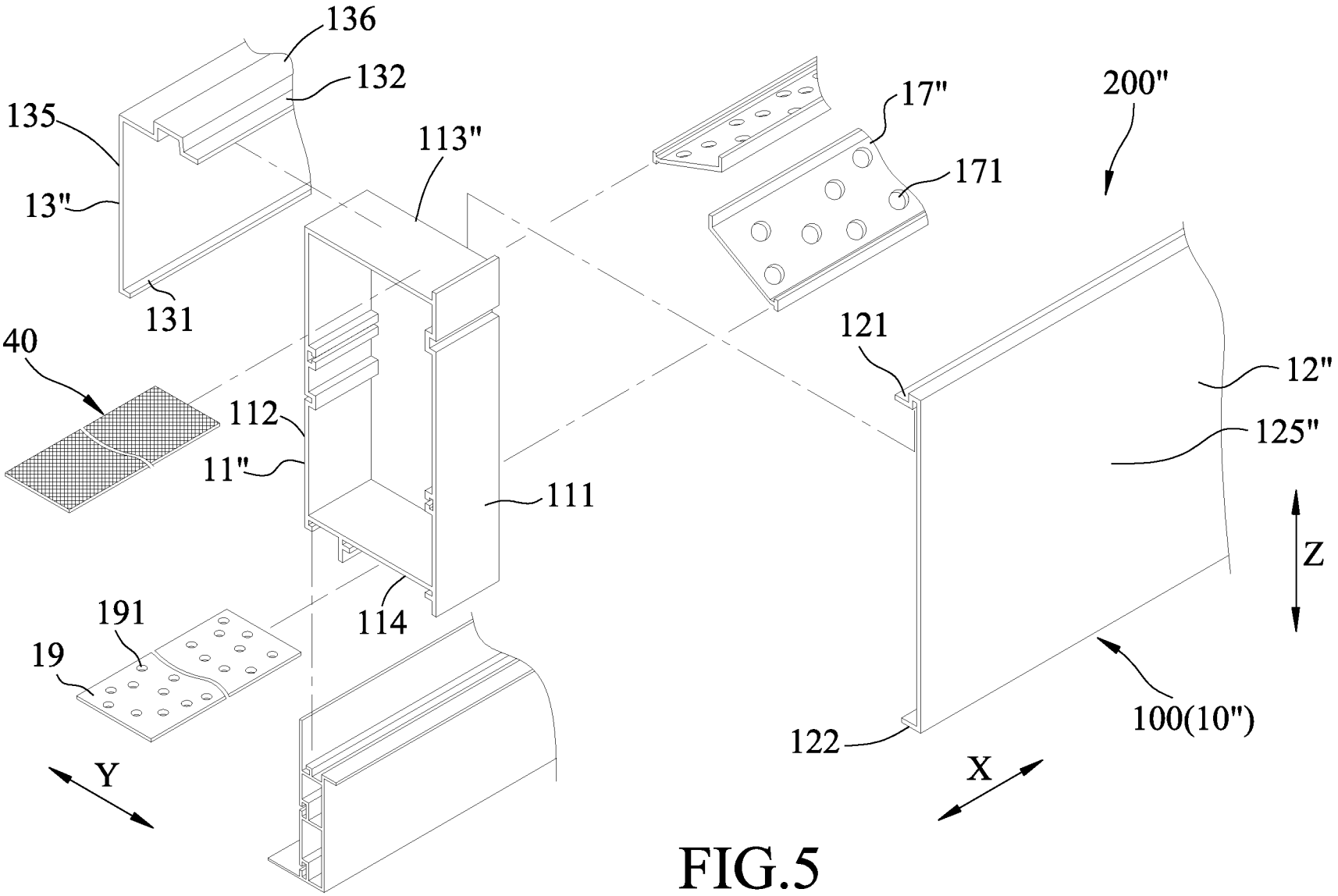
FIG. 5 is a fragmentary exploded perspective view of a ventilation assembly according to the third embodiment of the present disclosure.
Figure 6:
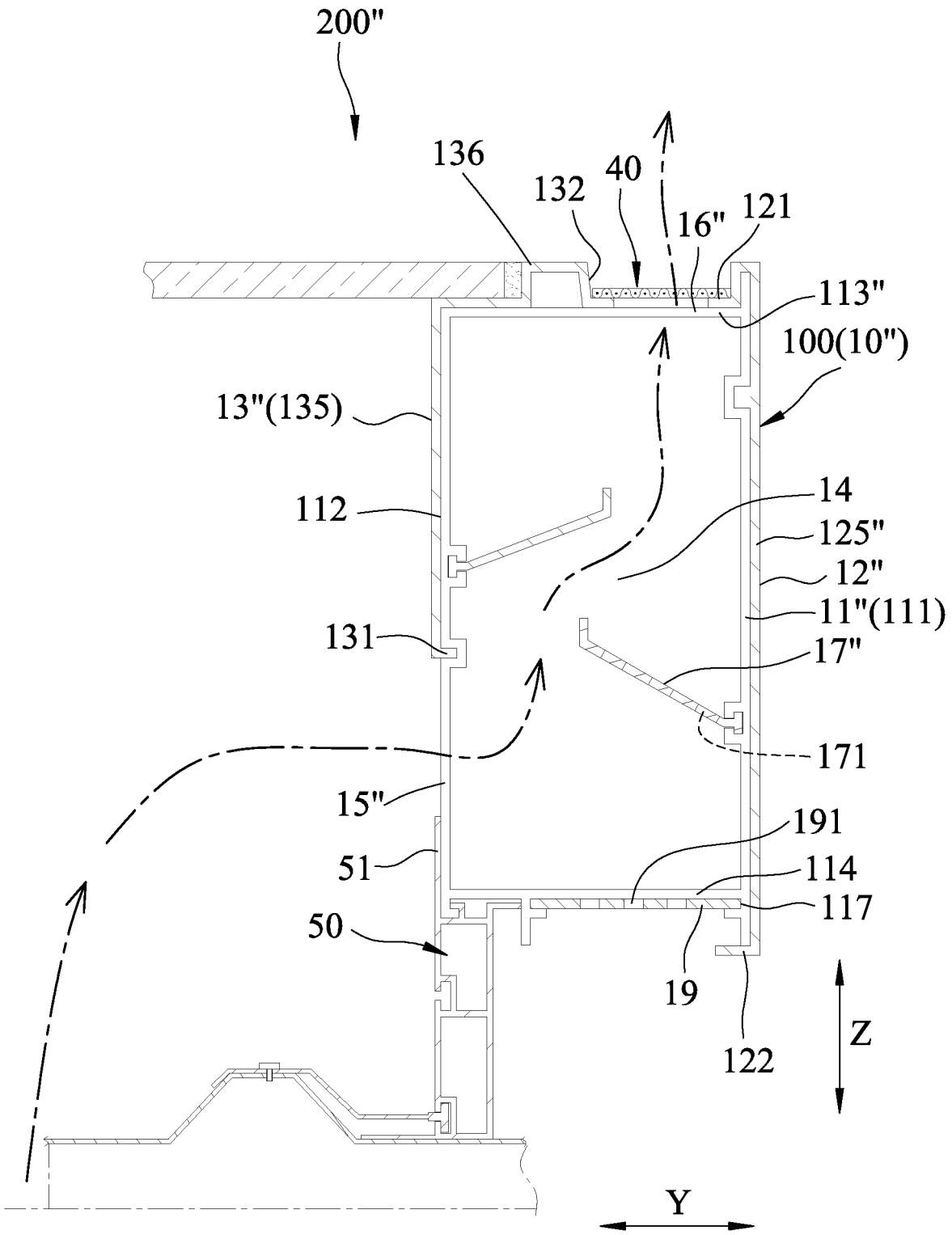
FIG. 6 is a fragmentary assembled sectional view of the third embodiment.

FIG. 5 is a fragmentary exploded perspective view of a ventilation assembly 200" according to the third embodiment of the present disclosure, and FIG. 6 is a fragmentary assembled sectional view of the third embodiment. The third embodiment is substantially identical to the first embodiment. However, in the third embodiment, the cross sectional shapes of the frame seat 11", the outer side plate 12" and the inner side plate 13" of each frame assembly 10" of the frame unit 100 are different from those of the first embodiment. Further, because the assembled positions of the outer and inner side plates 12", 13" relative to the frame seat 11" are changed, the first air vent 15" of each frame assembly 10" is proximate to the bottom walls 114 of the frame seats 11", while the second air vent 16" thereof is located between the top walls 113" of the frame seats 11". The purpose and effect of the first embodiment can be similarly achieved using the third embodiment.

In the third embodiment, the outer sideplate 12" does not have the cover plate portion 126 (see FIGS. 2 and 3), and the main plate portion 125" has the first end 121 fixedly abutting against outer sides of the top walls 113 of the frame seats 11" to cover a portion of a top side of the tortuous passage 14. The second end 122 of the main plate portion 125" is similarly engaged to the bottom portions of the outer walls 111 of the frame seats 11". Each frame assembly 10" further includes a drain plate 19 removably disposed between the tracks 117 of the bottom walls 114 of the frame seats 11" and corresponding to and covering a bottom side of the tortuous passage 14. The drain plate 19 is formed with a plurality of drain holes 191 for draining liquid from the tortuous passage 14. The inner side plate 13" includes a main plate portion 135 positioned on outer sides of the inner walls 112 of the frame seats 11", and a cover plate portion 136 connected to a top end of the main plate portion 135 and positioned on the outer sides of the top walls 113 of the frame seats 11" to cover another portion of the top side of the tortuous passage 14. The main plate portion 135 has the first end 131, while the cover plate portion 136 has the second end 132 spaced apart from and facing the first end 121 of the outer side plate 12".

The first air vent 15" of each frame assembly 10" is cooperatively defined by the frame seats 11", the first end 131 of the inner side plate 13" and the mounting seat 51 of a respective mounting unit 50. The second air vent 16" is cooperatively defined by the frame seats 11", the second end 132 of the inner sideplate 13" and the first end 121 of the outer side plate 12".

The top wall 113" of each frame seat 11" is not formed with the outer depression 1131 (see FIGS. 2 and 3).

The filter screen 40 of this embodiment is disposed between and supported by the second end 132 of the inner side plate 13" and the first end 121 of the outer side plate 12" to cover the remaining portion of the top side of the tortuous passage 14.

Each guide plate 17" of this embodiment is formed with a plurality of through holes 171. Liquid, such as rainwater, dripping from the second air vent 16" can be discharged outwardly and smoothly from the tortuous passage 14 through the guide plates 17" and the drain plate 19.

Figure 7:
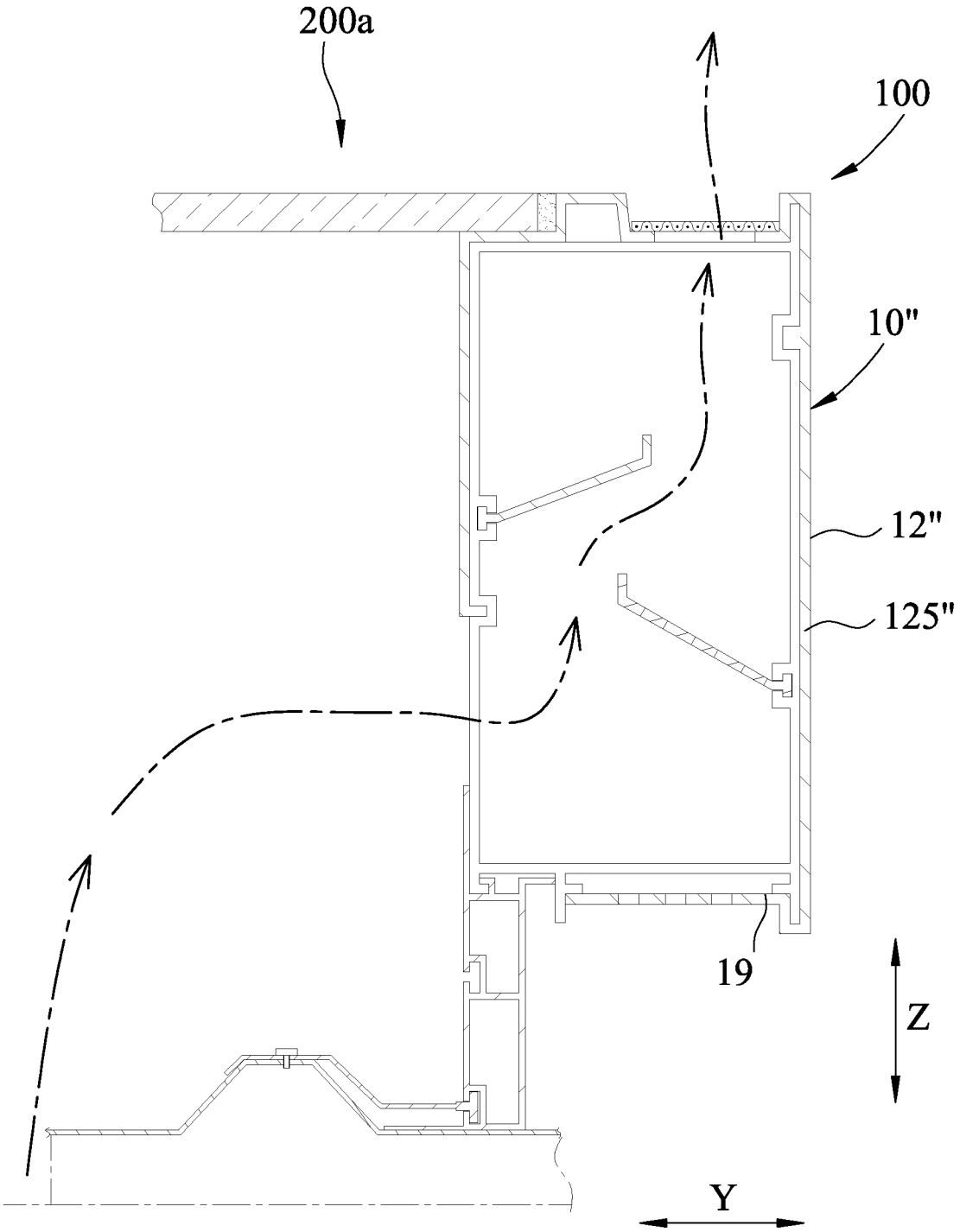
FIG. 7 is a fragmentary assembled sectional view of a ventilation assembly according to the fourth embodiment of the present disclosure.

FIG. 7 is a fragmentary assembled sectional view of a ventilation assembly (200*a*) according to the fourth embodiment of the present disclosure. The fourth embodiment is substantially identical to the third embodiment. However, in the fourth embodiment, the drain plate 19 is integrally connected as one piece with the main plate portion 125" of the outer side plate 12" of the frame assembly 10" of the frame unit 100. The effect and purpose of the third embodiment can be similarly achieved using the fourth embodiment.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A ventilation assembly comprising:

a frame unit including two frame assemblies, and two closing plates connected between said frame assemblies, each of said frame assemblies including at least two frame seats spaced apart from each other in a first direction, an outer side plate connected between said frame seats, and an inner side plate connected between said frame seats and spaced apart from and opposite to said outer side plate, wherein said frame seats, said outer side plate and said inner side plate of each of said frame assemblies cooperatively define a tortuous passage, each of said frame assemblies further including a first air vent cooperatively defined by at least said inner side plate and said frame seats, and a second air vent cooperatively defined by at least said outer side plate and said frame seats; and a cover body connected to and cooperating with said frame assemblies and said closing plates to define an air chamber, said air chamber being configured to communicate with an opening in an upper portion of a building;

wherein said first air vent is provided to communicate said air chamber with said tortuous passage, and said second air vent is provided to communicate said tortuous passage with the atmosphere;

wherein each of said frame seats has an outer wall fixed to said outer side plate, an inner wall fixed to said inner side plate, a top wall connected between top ends of said outer wall and said inner wall, and a bottom wall connected between bottom ends of said outer wall and said inner wall, said outer wall having a first engaging groove, said inner wall having a second engaging groove, each of said frame seats further having two guide plates respectively engaged to said first engaging groove and said second engaging groove;

wherein said outer side plate of each of said frame assemblies has a first end engaged to said inner walls of said frame seats, and a second end that is opposite to said first end, that is engaged to bottom portions of said outer walls of said frame seats and that is proximate to said bottom walls of said frame seats;

wherein said inner side plate has a first end engaged to said inner walls of said frame seats and spaced apart from said first end of said outer side plate, and a second end opposite to said first end of said inner side plate and proximate to a junction of said inner wall and said bottom wall of each of said frame seats;

wherein said first air vent is proximate to said top walls of said frame seats, and is cooperatively defined by said frame seats, said first end of said inner side plate and said first end of said outer side plate; and wherein said second air vent is located between said bottom walls of said frame seats, and is cooperatively defined by said frame seats, said second end of said inner side plate and said second end of said outer side plate.

2. The ventilation assembly as claimed in claim 1, further comprising two mounting units connected to said frame unit for mounting said ventilation assembly on the upper portion of the building.

3. The ventilation assembly as claimed in claim 2, wherein the upper portion of the building has an outer surface, the opening extends through the outer surface, and each of said mounting units includes a mounting seat fixed to said frame seats of a respective one of said frame assemblies, and a connecting member connected to said mounting seat and having a fitting portion, said fitting portion having a shape for conforming with the outer surface of the upper portion.

4. The ventilation assembly as claimed in claim 3, wherein said mounting seat has at least one engaging groove, said connecting member further having an engaging portion opposite to said fitting portion and engaged to said engaging groove, each of said engaging groove and said engaging portion having a T-shaped cross section.

5. The ventilation assembly as claimed in claim 4, wherein said at least one engaging groove includes two engaging grooves spaced apart from each other in a second direction transverse to the first direction, said engaging portion being engaged to a selected one of said engaging grooves.

6. The ventilation assembly as claimed in claim 1, wherein said bottom walls of said frame seats of each of said frame assemblies are respectively provided with tracks at bottom portions thereof.

7. The ventilation assembly as claimed in claim 6, wherein said frame unit further includes two filter screens each of which is removably disposed between said tracks of said bottom walls of said frame seats of a respective one of said frame assemblies and each of which corresponds to said second air vent of the respective one of said frame assemblies.

8. A ventilation assembly comprising:

a frame unit including two frame assemblies, and two closing plates connected between said frame assemblies, each of said frame assemblies including at least two frame seats spaced apart from each other in a first direction, an outer side plate connected between said frame seats, and an inner side plate connected between said frame seats and spaced apart from and opposite to said outer side plate, wherein said frame seats, said outer side plate and said inner side plate of each of said frame assemblies cooperatively define a tortuous passage, each of said frame assemblies further including a first air vent cooperatively defined by at least said inner side plate and said frame seats, and a second air vent cooperatively defined by at least said outer side plate and said frame seats; and a cover body connected to and cooperating with said frame assemblies and said closing plates to define an air chamber, said air chamber being configured to communicate with an opening in an upper portion of a building;

wherein said first air vent is provided to communicate said air chamber with said tortuous passage, and said second air vent is provided to communicate said tortuous passage with the atmosphere;

wherein each of said frame seats has an outer wall fixed to said outer side plate, an inner wall fixed to said inner side plate, a top wall connected between top ends of said outer wall and said inner wall, and a bottom wall connected between bottom ends of said outer wall and said inner wall, said outer wall having a first engaging groove, said inner wall having a second engaging groove, each of said frame seats further having two guide plates respectively engaged to said first engaging groove and said second engaging groove; and wherein said outer side plate of each of said frame assemblies includes a main plate portion positioned on outer sides of said outer walls of said frame seats, and a cover plate portion that is connected to a top end of said main plate portion of said outer side plate, that is disposed on outer sides of said top walls of said frame seats, and that covers a top side of said tortuous passage, said cover plate portion having said first end of said outer side plate, said main plate portion having said second end of said outer side plate.

* * * * *